United States Patent [19]

Roccaforte et al.

[11] 4,448,309

[45] May 15, 1984

[54] CONTAINER FOR EXPANDABLE FOOD POUCH

[75] Inventors: Harry I. Roccaforte, Western Springs; Raymond G. Scott, Oak Brook, both of Ill.

[73] Assignee: Champion International Corporation, Stamford, Conn.

[21] Appl. No.: 422,472

[22] Filed: Sep. 23, 1982

[51] Int. Cl.[3] ..... B65D 5/36

[52] U.S. Cl. ..... 206/525; 229/41 C; 229/DIG. 3; 426/107; 426/111; 426/124

[58] Field of Search ..... 229/41 C, 41 D, DIG. 3; 206/825; 426/107, 111, 124

[56] References Cited

U.S. PATENT DOCUMENTS

| | | | |
|---|---|---|---|
| 1,968,661 | 7/1934 | Towell | 229/41 D |
| 2,054,473 | 9/1936 | Towell | 229/41 D |
| 2,083,345 | 6/1937 | Paige | 229/41 D |
| 2,749,018 | 6/1956 | Berke | 229/41 D |
| 2,922,562 | 1/1960 | Pellaton | 229/41 D |
| 3,630,430 | 12/1971 | Struble | 229/41 D |
| 4,360,146 | 11/1982 | Koltz | 229/41 D |

FOREIGN PATENT DOCUMENTS

| | | | |
|---|---|---|---|
| 1193505 | 11/1959 | France | 229/41 C |

*Primary Examiner*—Joseph Man-Fu Moy
*Attorney, Agent, or Firm*—Evelyn M. Sommer

[57] ABSTRACT

An expandable food such as popcorn is sealed within a pouch formed of a substantially oxygen-impermeable, flexible, synthetic high polymer film which is dimensioned so as to fit for storage and efficient cooking of the food product in an outer bowl-like protective paperboard container. The outer container and pouch can be heated in a microwave oven and the expandable pouch and food is supported and confined in the bowl of the outer container, from which the food can be consumed. The outer container is formed from a unitary blank which can be partially erected and shipped in a flat, knock-down condition to a food processor for filling with the food pouch. The base of the outer container is provided with self-locking tabs to prevent the bowl-like container from collapsing and returning to its knock-down, shipped condition after fully erected and filled with the food pouch.

22 Claims, 40 Drawing Figures

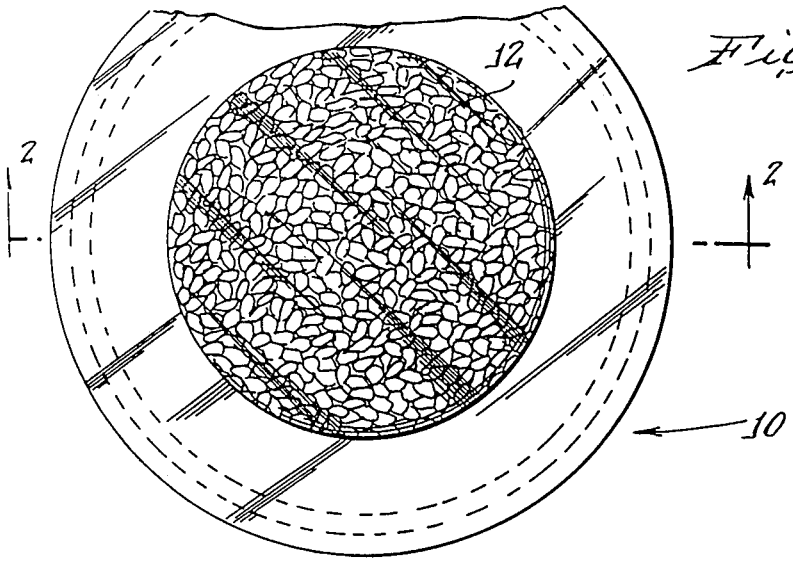
Fig. 1.
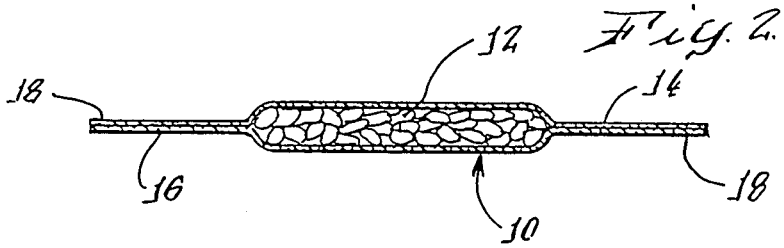
Fig. 2.
Fig. 3.
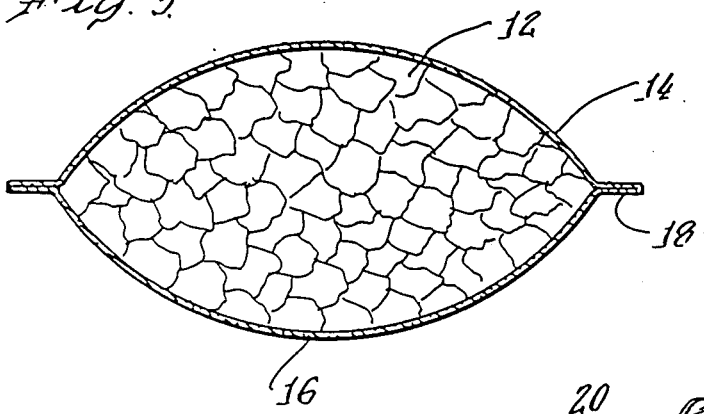
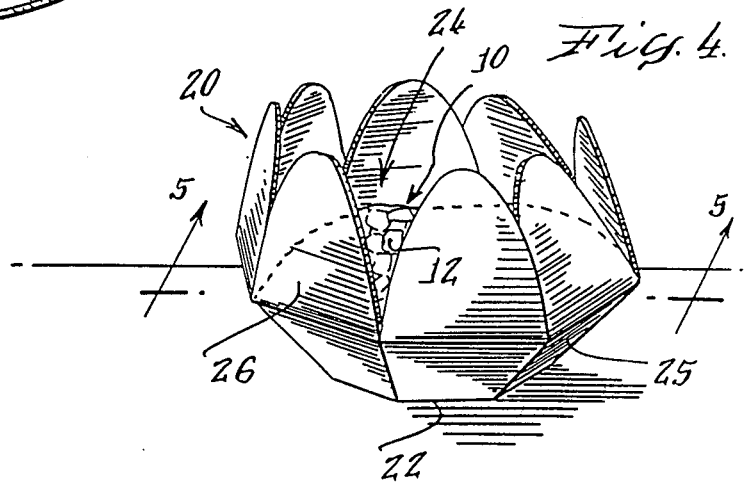
Fig. 4.

Fig. 8.
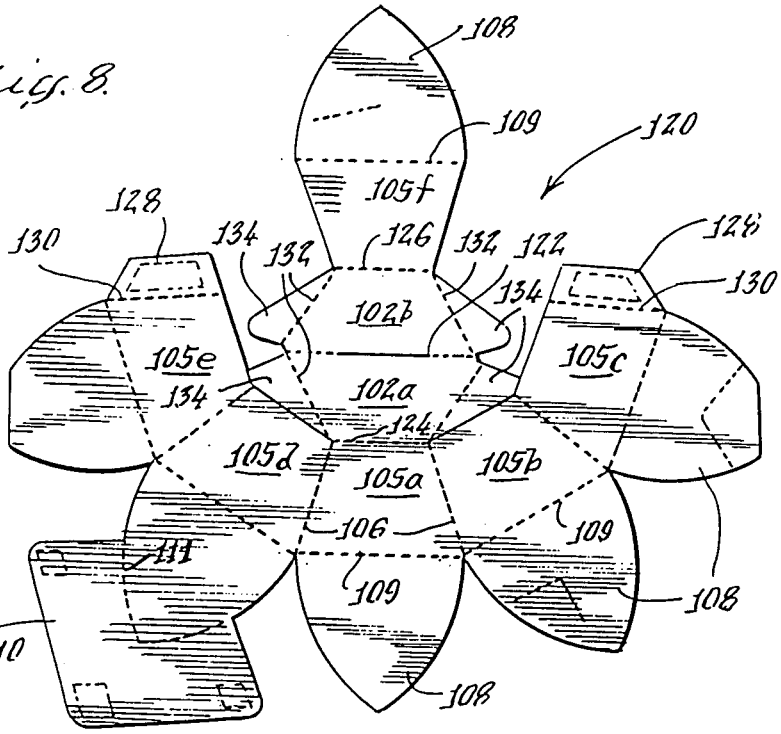
Fig. 10.
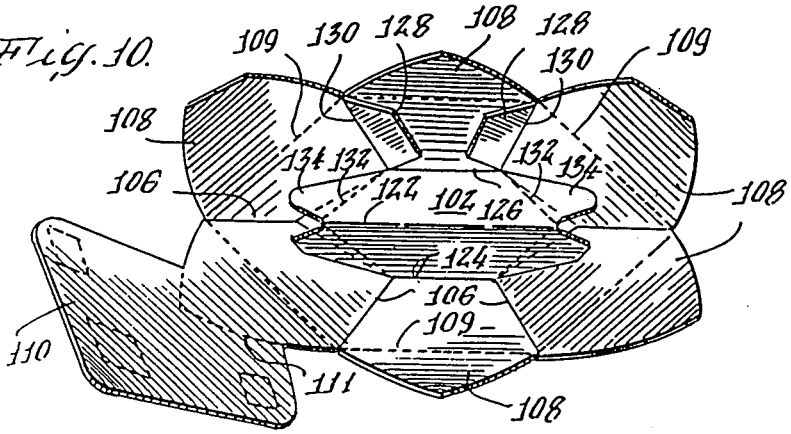
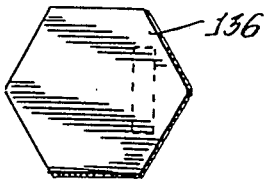
Fig. 9.
Fig. 11.
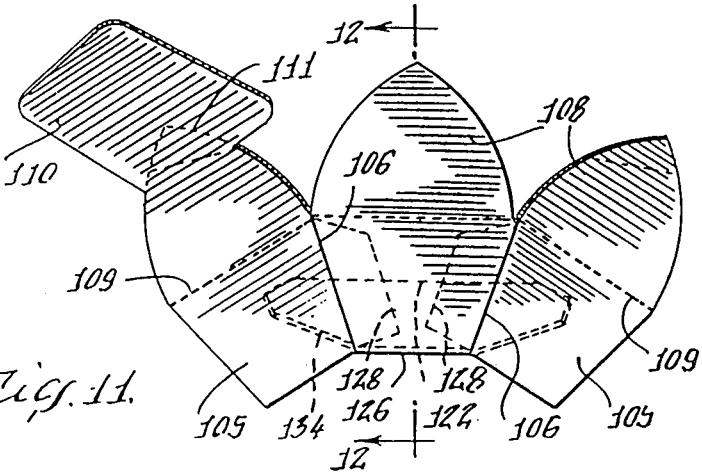
Fig. 12.
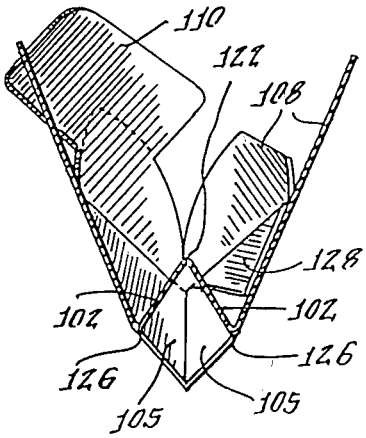

Fig. 14.
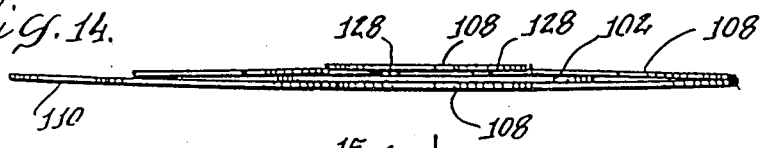
Fig. 15.
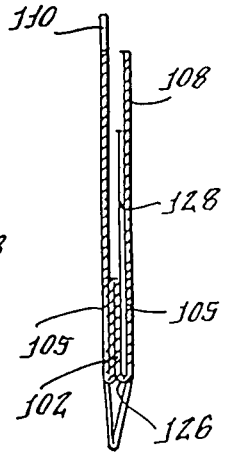
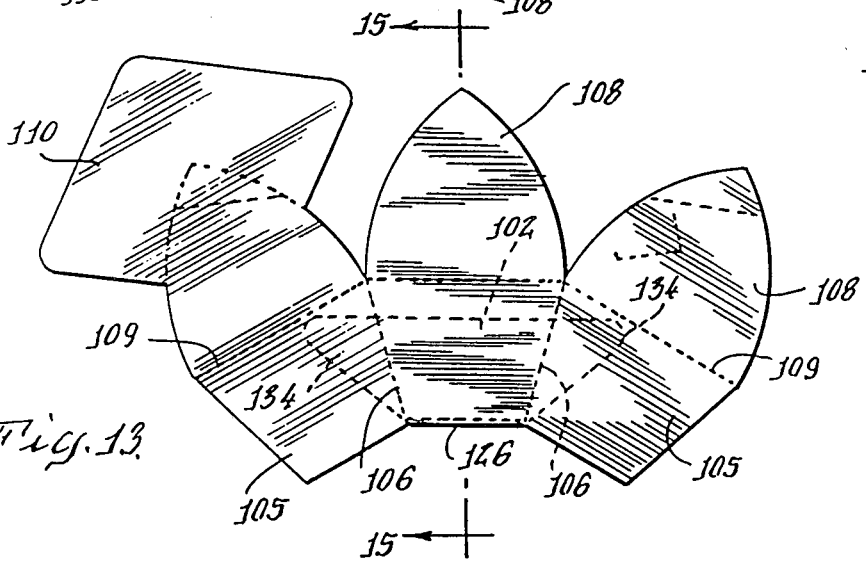
Fig. 13.
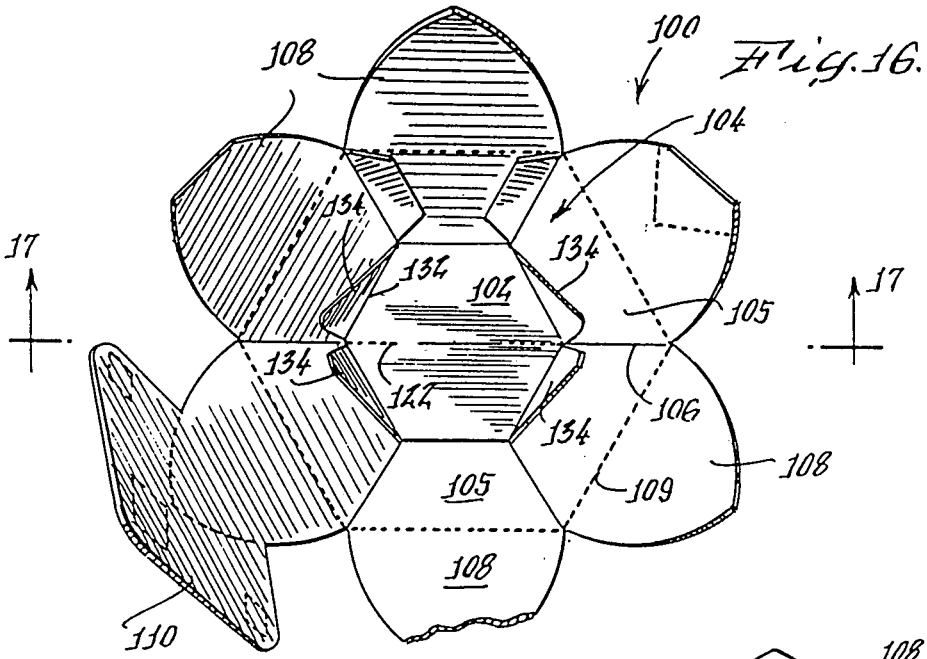
Fig. 16.
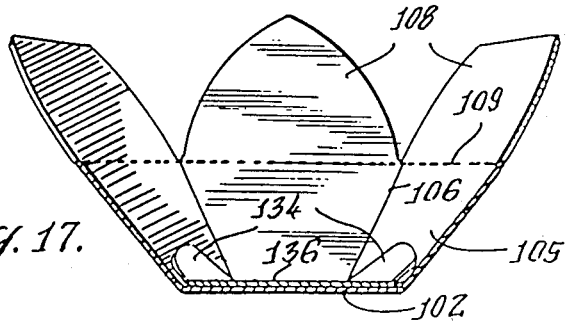
Fig. 17.

Fig. 23.
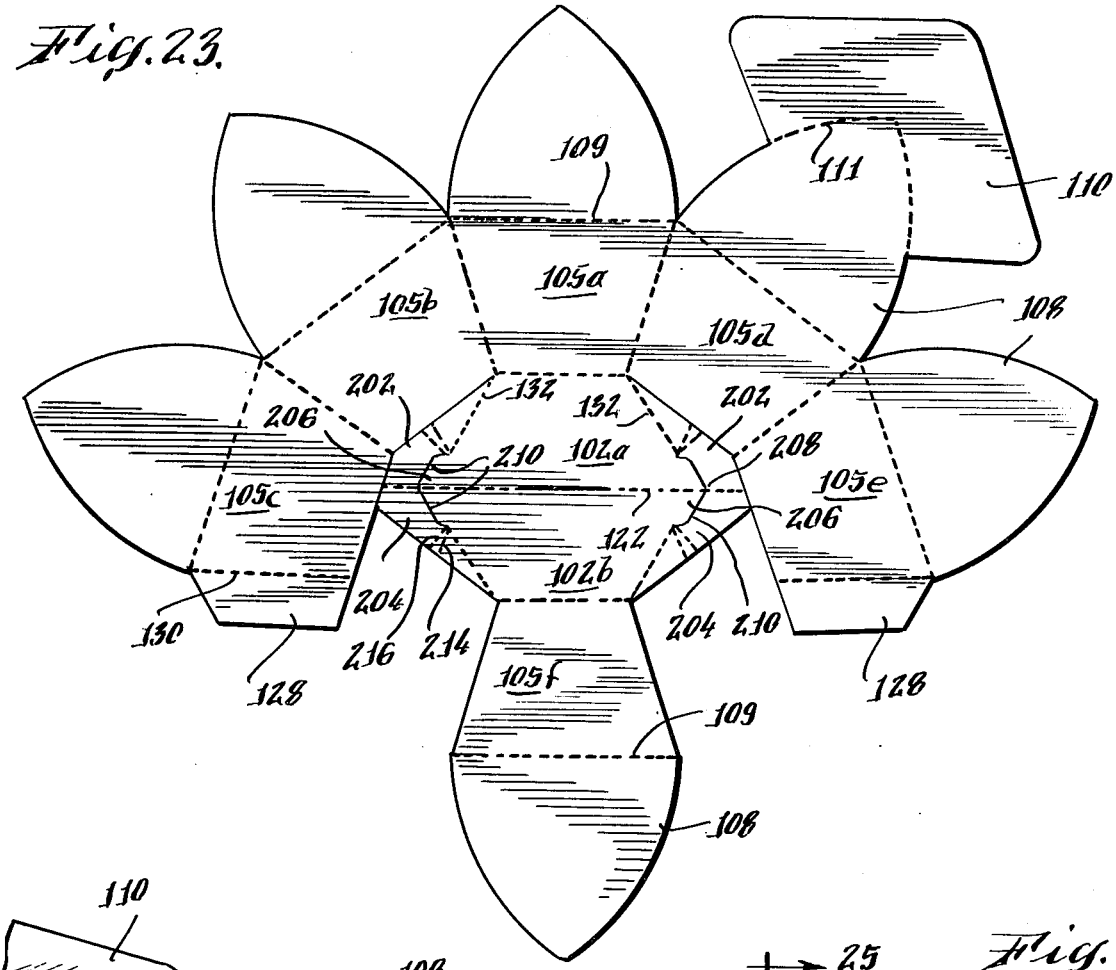
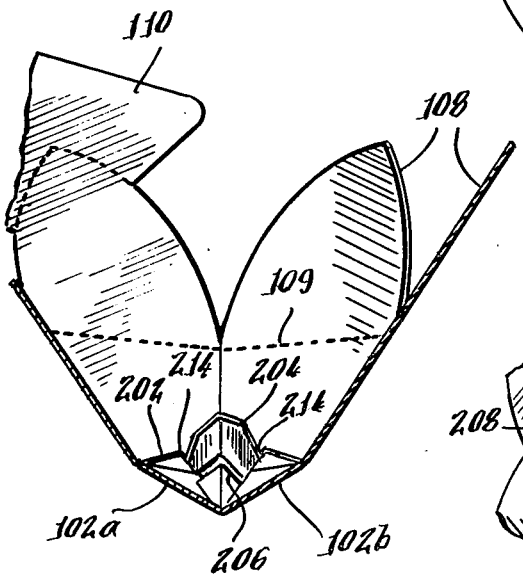
Fig. 25.
Fig. 24.
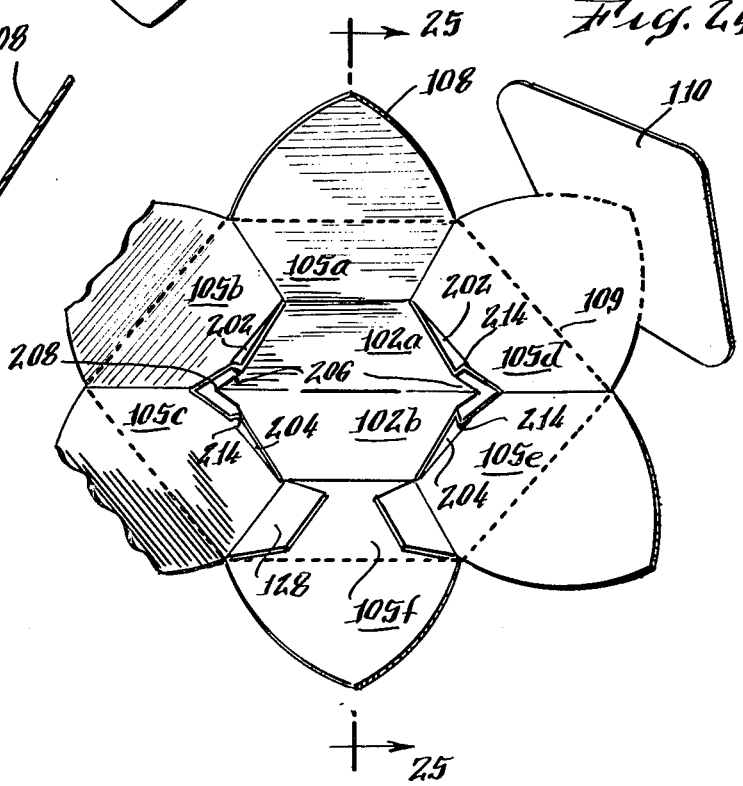

CONTAINER FOR EXPANDABLE FOOD POUCH

BACKGROUND OF THE INVENTION

1. Field of the Invention:

This invention relates generally to a bowl-like container adapted to hold a packaged food and more particularly, a bowl-like container for an expandable food pouch which can be heated in a microwave oven.

2. Description of the Prior Art:

The prior art has developed many expandable food packages adapted for storing and cooking expandable food products such as popcorn. Generally, packages of this type comprise an aluminum pan portion having an expandable aluminum cover. A container of this type is disclosed in U.S. Pat. No. 2,815,883. Because of the excellent moisture barrier and heat conduction properties of aluminum foil, it is well suited for use in this type of container which is used for storing as well as popping the popcorn. In operation, the container is placed over a suitable heat source which brings the contents of the container to proper popping conditions. As popping progresses, the foil top expands from a crimped condition to make room for the popcorn in its popped state.

A similar metal foil container is also disclosed in U.S. Pat. No. 3,052,554. In this patent, two sheets of light gauge metal foil, such as aluminum foil are placed in overlying, substantially, face to face relationship secured together substantially along their edges by adhesive or mechanical means. The popcorn is mixed with frying fat and disposed between the two face to face foil sheets. The pouch is heated in a pan and will expand upon the application of heat to assume a rotund or pillow shape having a somewhat semi-eliptical upper and lower section. This patent also discloses that the expandable pouch can be formed in a variety of shapes such as square, round or circular, etc.

While these containers have been a great commercial success and have provided a convenient means for both storing and preparing popcorn, they are not suitable for use with microwave heating means. Aluminum foil effectively shields the product from microwave energy and prevents it from heating the package contents. Thus, the popular expandable aluminum foil popcorn package cannot be employed for heating the popcorn by microwave energy.

U.S Pat. No. 4,036,423 provides a non-metallic, expandable food package which is capable of storing expandable foods such as popcorn and then heating them in microwave ovens. The disclosed package has a base portion which includes foldably attached, integral flanges to which a cover of flexible plastic film is secured along a continuous periphery, resulting in a totally enclosed container. Because the closed container is formed by the combination of the base portion and the film cover, the base portion must be made of a material which will serve as a suitable moisture, oxygen and fat barrier. Also, the base portion must be constructed of a material capable of forming an effective seal with the film. Thus, the material for forming the container will be relatively expensive and a high degree of control must be exercised during formation of the container. The construction of the container is made more difficult by the necessity for sealing the film to the base portion flanges after assembly of the base portion.

U.S. Pat. No. 3,973,045 illustrates a self-contained popcorn package suitable for microwave heating. However, the package is not adapted to be stored in an outer container wherein it can be readily and expediently cooked in that container and the contents, after cooking, confined and consumed.

U.S. Pat. No. 3,672,907 illustrates that polyethylene terephthalate can be used as a packaging film or pouch under high temperature conditions.

However, until the inventions of Austin alone, and Austin and Kane, assigned to the same assignee as the present application, and entitled "Expandable Food Pouch and Container", the disclosures of which are incorporated by reference herein, the prior art was substantially devoid of any teachings whatsoever of the combination of an outer bowl-like carton or container preferably made of inexpensive paperboard, which can contain an expandable and separate polyethylene terephthalate package containing an expandable food product such as popcorn, which can be heated in the original outer, paperboard package in a microwave oven; the inner package being specifically dimensioned and conformed to the shape of the container so that its expansion is contained wholly within the confines of the outer bowl-like container and progresses in an orderly confined manner in a confined space, precluding the inner package or pouch from bursting thereby spilling the contents thereof or being uncontrolled to the extent that opening of the expandable package or pouch will cause the expanded food product, such as popcorn, to overflow the confines of the outer container and be placed in an unsanitary environment prior to being consumed. Further, the inner package is dimensioned so as to be supported in the container to assure proper drainage of the cooking fats and oils during heating of the product so the product cooks completely in an expedient fashion.

Specifically, in the Austin and Kane, and Austin inventions, a pouch is disclosed which includes an expandable food product sealed within the pouch. The pouch is formed of a substantially oxygen-impermeable, flexible, synthetic high polymer film capable of maintaining product freshness over extended periods of time and withstanding the temperatures and moisture vapor developed upon heating the packaged food product in a microwave oven for a period of time effective to fully expand the food product to a volume of at least twice that as packaged. The expandable food product is sealed in a circular configuration in the center of the pouch. The outer edges of the pouch are also heat-sealed and formed into a concentric circle with the expandable food product.

A planar projection of the diameter of the expandable food product in the pouch is substantially equivalent to a diagonal of the planar projection of a polygonally shaped mouth of an outer bowl-like paperboard container or carton in which the pouch is sealed and adapted to expand during heating. The outer carton or container also has a complemental, polygonally shaped base and sloping side walls forming an inverted frustrum. Because the circumference of the pouch substantially coincides with the periphery of mouth of the outer bowl-like paperboard container or carton containing the pouch, the pouch can be wholly sealed in bulk within the interior of the outer paperboard bowl-like container by folding and overlapping the non-food filled portions of the pouch back on itself. Portions of the circular portion of the pouch containing the food product are supported upon the sloping sidewalls and polygonal base of the container enabling the pouch to be heated and expanded in a controlled, substantially vertical manner wholly within the interior of the outer dimensions of the outer bowl-like paperboard container and enabling cooking fats and oils mixed with the expandable food product to drain along the sidewalls of the outer container in the pouch towards the base to assure expedient and full cooking of the food product.

In one form of the outer, bowl-like carton or container, the carton is provided with a substantially hexagonal base and a planar projection, hexagonal mouth and is adapted to be expediently erected from a flat, knock-down, shipped condition received from a carton manufacturer to an inverted frustrum or bowl filled with an expandable food product at the situs of the food product manufacturer, without the use of special package or carton forming equipment. In order to obtain such a carton, the base of the carton blank includes a pair of trapezoidal base portions joined by a cut or serrated scoreline so that the base can be folded 180° back upon itself wherein the sidewalls can lie on top of each other. To erect the carton, it is only necessary to unfold the base to a flat or planar condition and the sidewalls will extend upwardly and outwardly from the base ready to receive the expandable food pouch.

The carton or container, however, has a tendency to collapse about the base fold line to its knock-down condition. A separate, hexagonally-shaped panel is provided and dropped into the carton onto the base portion to preclude the base portions from collapsing towards each other. However, this was time consuming and involved the provision of additional costly materials which had to be stocked.

SUMMARY OF THE INVENTION

The present invention provides means on the container to preclude collapse of the base of the outer bowl-like container or carton without the use of an additional, separate, structural base panel to prevent pivoting of the base about its central scoreline, once the carton is erected.

In accordance, with the invention, the base is provided with opposed pairs of substantially triangular abutment tabs which are placed in abutment with the bottom interior surface of adjacent trapezoidal sidewalls to rigidify the bowl-like configuration of the container or carton. A substantially V-shaped lock tab is cut from opposite pairs of adjacent abutment tabs extending from the base. The V-shaped lock tab has an apex coincident with the foldline bisecting the base. Upon erection of the carton or container by placing the abutment tabs into contact with the bottom interior surfaces of adjacent trapezoidal sidewalls, the base will remain substantially horizontal with the apex of each V-shaped tab extending through and behind its cutline, slightly beyond and beneath a pair of adjacent trapezoidal sidewalls, to lock the base in its unfolded, horizontal position.

Each triangular abutment tab may be scored across its width to facilitate bending of the abutment tab relative to the V-shaped lock tab and to release the lock tab from its cutline.

BRIEF DESCRIPTION OF THE DRAWINGS

The invention will become better understood and its advantages will become more apparent in view of the following detailed description, especially when read in light of the attached drawings wherein:

FIG. 1 is a top plan view of a preferred embodiment of a packaged, expandable food product or pouch used with the container of the present invention;

FIG. 2 is a cross-sectional view taken along line 2—2 in FIG. 1;

FIG. 3 is a cross-sectional view taken along a line similar to that of 2—2 in FIG. 1 but of the package after expansion of the food product with it;

FIG. 4 is a perspective view illustrating the packaged, expandable food product positioned within a partially opened, protective outer carton;

FIG. 8 is a plan view of an alternate form of a blank for forming the outer carton;

FIG. 9 is a plan view of a stiffening panel adapted to be used with the blank of FIG. 8;

FIGS. 10 through 18, inclusive, illustrate succesive steps in the folding of the blank of FIG. 8 into an outer carton, with FIGS. 12, 15 and 17 comprising cross-sectional views taken substantially along the planes indicated by lines 12—12, 15—15, and 17—17 in FIGS. 11, 13 and 16, respectively, and FIG. 14 comprising a top plan view of the folded blank of FIG. 13;

FIG. 23 is yet another alternate form of blank for forming the outer carton;

FIGS. 24 to 28 illustrate successive steps in the folding of the blank of FIG. 23 into an outer carton, with FIGS. 25 and 27 comprising cross-sectional views taken substantially along the planes indicated by lines 25—25 and 27—27 in FIGS. 24 and 26, respectively, and FIG. 28 comprising a bottom plan view of the folded blank of FIG. 27;

DETAILED DESCRIPTION OF THE PREFERRED EMBODIMENT

Figure 5:
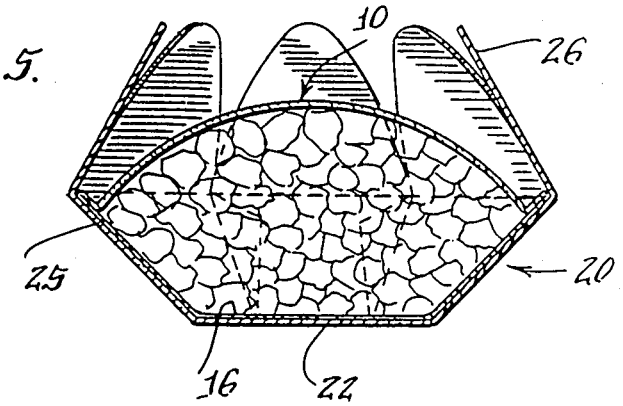
FIG. 5 is a cross-sectional view taken substantially along the plane indicated by line 5—5 of FIG. 4.

Disclosed is the combination of an improved package or pouch containing an expandable food product housed within a bowl-like outer cooking vessel. By "expandable food product" is meant any product such as popcorn, which expands upon heating to a volume of two or more times its original volume. The preferred containers according to the present invention are designed to accommodate an expansion of at least five times the original volume of the food product, and most preferably will accommodate an expansion of greater than ten times the original product volume.

The pouch and container are specifically designed for and especially adapted to enable heating and expansion of the food product within microwave ovens. Accordingly, the pouch and container must be made of materials capable of withstanding the temperatures and the internal pressures generated during heating. For example, in the case of popping popcorn, the popcorn will normally be packaged with an oil which will reach a temperature in excess of 150° C. during heating and the popcorn will expand with successive explosive releases of steam as each kernel pops.

According to FIG. 1, a round flat package or pouch, generally designated 10, will be provided containing a measured portion of an expandable food product 12 positioned therein. In this particular instance the expandable food product will be popcorn admixed with a suitable quantity of fat. It is to be understood that the term fat will include all of those triglyceride materials normally employed for cooking, and can be either solid or liquid at room temperature and be of animal or vegetable origin. Typical among the fats which can be employed are butter, coconut oil, soybean oil, cotton-seed oil, tallow, and combinations of these. The specific type of fat is of course not important to the functioning of the present invention and can be selected depending upon the taste and quality to be imparted to the food product. While the expandable package or pouch 10 can be of any desired shape, depending on the shape of the outer protective package it has been found that a circular package, having a circular-shaped measured food portion 12 positioned at the center, will provide the best combination of ease in packaging, cooking and expansion upon heating.

As can be seen best in the cross-sectional view of FIG. 2, the package is comprised of opposed layers of synthetic high polymer film. The two layers can be of the same or of different compositions as long as they are effective for maintaining shelf stability during the storage of the food product after packaging and prior to use over extended periods of time and withstanding the temperatures and moisture vapor developed upon heating the packaged food product in a microwave oven for a period of time effective to fully expand the food product. The film material must be capable of forming an effective seal with the opposed surface of film so that the two layers 14 and 16 can be sealed about their peripheral edges as indicated at 18 in FIG. 2 to form an entirely enclosed space. Where the shape of the package will permit, it can be formed from a folded single sheet of film or tubular film with the open edges sealed to provide a completely enclosed space.

The seal 18 will be formed along all open edges around the periphery of the opposed film surfaces 14 and 16 to provide an enclosed space between the films which is large enough to accommodate expansion of the food product to at least two times its original size. As indicated previously, it will preferably permit expansion of the food product to a volume five times its original size, and in the case of products such as popcorn an available volume for expansion should be at least ten times the original volume of the food product. The seal can be formed by the use of adhesives, solvents or heat sealing means as are known in the art. Preferably, the seal is made by heat sealing with the width of the seal being from about $\frac{1}{8}$ to about $\frac{1}{2}$ inch, most preferably the seal is about $\frac{1}{4}$ inch wide.

The film employed to form the package should be substantially impermeable to oxygen and moisture vapor so that it maintains the freshness of the packaged product for a commercially acceptable period of time. While storage of at least six months, and preferably twelve months, are generally considered necessary, the exact time will depend upon the nature of the product. In the case of popcorn packaged with fat, the film must not permit significant changes in the moisture content of the popcorn kernels and must not permit oxygen to permeate the film to cause rancidification of the fat. Acceptable periods of shelf life for popcorn will be on the order of from about 6 months to about one year, with a preferred shelf stability being defined as maintaining the ability of the popcorn to essentially completely pop after being subjected to storage under normal conditions of temperature and humidity for a period of at least one year.

Both layers, 14 and 16, of film will preferably be made of the same material. It has been found that polyethylene terephthalate is an especially effective packaging material for this particular purpose because of its low oxygen and moisture permeabilities. Suitable results in terms of shelf stability and package performance upon heating have been achieved with polyethylene terephthalate films having a thickness of from about 0.027 mm to about 0.0254 mm. If desired, the polyethylent terephthalate film can be treated by coating with polyvinylidene chloride to improve its oxygen and moisture barrier properties or the polyethylene terephthalate may be applied as the outermost layers of a multi-layer structure, for instance, polyethylene terephthalate, polyvinylidene chloride, Saran or nylon, and polyethylene terephthalate. It is well known in the art that there are other suitable alternative film materials which can be employed such as laminates of polyvinylidene chloride and polyethylene, polyvinyl chloride, and polypropylene. It is presently believed, however, that the use of the polypropylene terephthalate films provide the best combination of cost and effectiveness.

The expandable food package or pouch 10 containing the expandable food product requires very little storage space prior to cooking. Preferably, it is enclosed within an outer carton such as the type identified as 20 and shown in FIGS. 4 to 7 which has the bowl-like shape of an inverted frustrum with a polygonal, such as an octagonal base 22 and a planar projection, octagonal top opening or mouth 24 connected to the base 22 by trapezoidal side walls 25 which are alternatively folded over interconnecting triangular panels into abutment along their outer edges to form a bowl. The octagonal top opening or mouth 24 is closed or covered by interleaving petal-like tabs 26 which are foldably connected to each side wall 25 and which fold over each other and are sealed into place for storage, as shown in FIG. 6. The outer carton 20 is more fully described in U.S. Pat. No. 4,279,933, issued July 21, 1981. The disclosure of the same is incorporated herein by reference.

Figure 6:
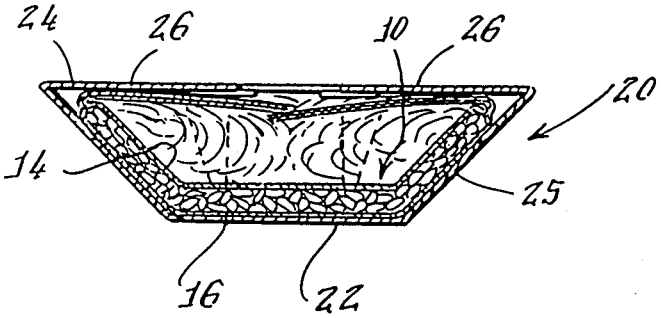
FIG. 6 is a view similar to FIG. 5 but illustrating the manner of packaging the expandable food product or pouch within the protective outer carton prior to its expansion under the application of heat to the outer carton.
Figure 7:
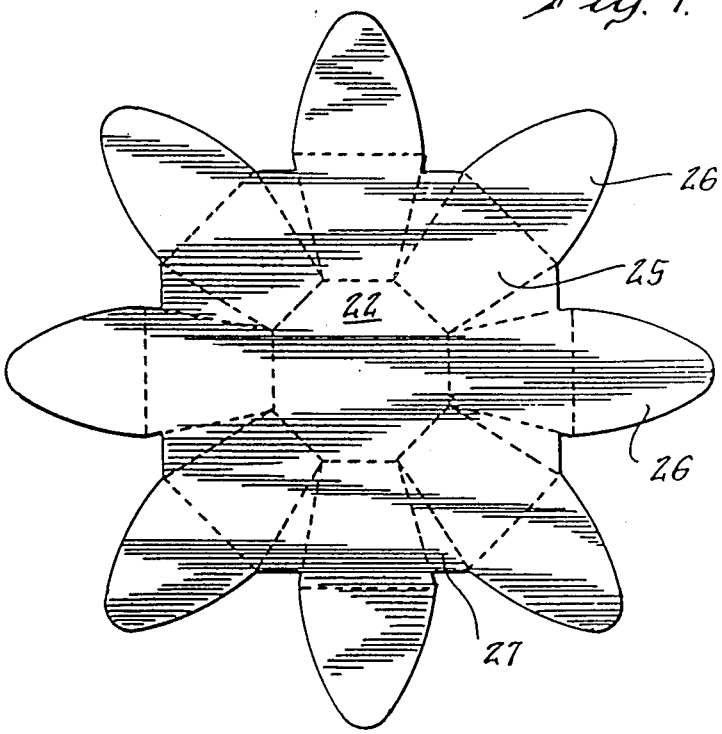
FIG. 7 is a plan view of the blank of the outer carton illustrated in FIGS. 4, 5 and 6.

For heating the food product 12 within the package or pouch 10, the interleaved tabs 26 of outer carton 20 are opened to the position shown in FIGS. 4 and 5 and the carton is then placed within a microwave oven for heating. During the heating cycle, the package or pouch 10 is expanded by the expansion of the food product 12 within the package and the release of gases, principally water vapor form the product as it is heated. A fully expanded package 10 comprising the fully expanded food product, without lateral restraint is shown in cross section in FIG. 3. However, the diameter of the food product 12 in pouch or package 10 is selected so that the circumference of the food product substantially coincides with the periphery of octagonal mouth 24 of the bowl-like carton 20 when the concentric food product 12 is seated on octagonal base 22, as shown in FIG. 6, so that the food product 12 will also seat along the sloping sidewalls 25. Because of these dimensions, expansion of the pouch 10 upon heating will proceed as shown in FIG. 5 so that the entire contents of the expanded food pouch will be wholly within the interior of the outer carton 20 and rise in a substantial vertical direction only; the sides of the package 10 being constrained by virtue of the relatively rigid side panels 25 of the outer carton 20. Upon heating, the cooking oils and fat admixed with the food product 12 will also, because of the dimensions of food product 12, drain in pouch 10 along the sloping sidewalls 25 of bowl-like container 20 to the bottom of the pouch to assure complete cooking of the entire food product in an expedient time. Further, as indicated in FIG. 6, prior to expansion, the outer periphery of the package 10 can be easily folded and fitted within the interior of the outer carton 20 to provide bulk and to permit ready unfolding and expansion upon heating of the outer container 20.

Alternatively, the outer carton can be of the bowl-like type shown in FIGS. 8 to 22 and designated by the numeral 100. The carton 100 has a substantially hexagonal base 102 and a planar projection, hexagonal mouth 104 and is adapted to be expediently erected from a flat, knock-down, shipped condition received from a carton manufacturer to an inverted frustum or bowl and filled with an expandable food product at the situs of the food product manufacturer, without the use of special package or carton forming equipment.

Figure 19:
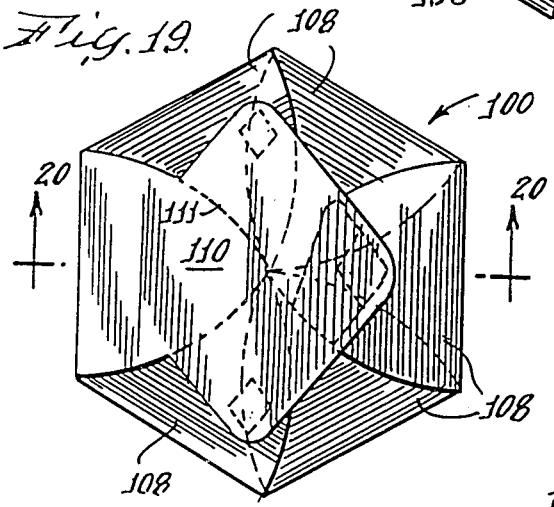
FIG. 19 is a top plan view of the outer carton formed by folding the blank of FIG. 8, filled with an expandable food pouch.

As in carton 20, the top opening or mouth 104 is connected to the base 102 by trapezoidal side walls 105. However, the side walls 105 are pivotably connected to each other along fold or scorelines 106. The hexagonal top opening or mouth 104 is closed by interleaving petal-like closure tabs 108, which are connected to each side wall 105 by a scoreline 109, enabling each tab to fold over each other in succession. One of the petal-like tabs 108 is provided with a seal tab 110, of any suitable shape, e.g., circular, triangular or diamond-shaped, which is glued or otherwise sealed to an adjacent tab 106, as shown in FIG. 19, to close the carton for storage.

The carton 100 is formed from a unitary, planar paperboard blank 120 illustrated in FIG. 8. The blank 120 includes a pair of substantially trapezoidal base portions **102*a* and 102*b* joined by a cut or serrated scoreline 122. Connected by a scoreline 132 to each lateral or side edge of trapezoidal base portions 102*a* and 102*b* is a triangular abutment tab 134. Connected to the outermost or top edge of base portion 102*a* by a scoreline 124 is the smaller parallel edge of one of the trapezoidal side wall panels 105*a***.

Connected to opposed edges of trapezoidal side wall panel **105*a* by scorelines 106 are a pair of trapezoidal side wall panels 105*b*, 105*c* and 105*d*, 105*e*, respectively. A petal-like closure tab 108 is connected by a scoreline 109 to the larger parallel edge of each of the trapezoidal side wall panels 105*a*, 105*b*, 105*c*, 105*d* and 105*e*. A diamond-shaped seal tab 110 is connected by a broken, cut or serrated scoreline 111 to the petal-like closure tab 108 foldably connected to trapezoidal side wall panel 105*b***.

A single trapezoidal side wall panel **105*f* is foldably connected by a scoreline 126 to the outermost or top edge of base portion 102*b*. A single petal-like closure tab is foldably connected by a scoreline 109 to the larger parallel edge of trapezoidal side wall panel 105*f*. A glue tab 128 is connected by a scoreline 130 to sidewall panels 105*c* and 105*e*** to complete the blank construction.

The blank 120 is folded to form carton 100 as illustrated in FIGS. 8 to 18.

Glue tabs 128 are adhered to the interior opposed surfaces adjacent the lateral edges of trapezoidal sidewall **105*f*. The triangular abutment tabs 134 are folded about their adjacent scorelines 132 and placed in abutment with the bottom interior surface of trapezoidal sidewalls 105*d*, 105*e*, 105*f* and 105*c*, as shown in FIG. 10. The trapezoidal base portion 102*a* and 102*b* are then folded into facing relation about cut scoreline 122, as shown in FIGS. 11 to 15, inclusive. In this knock-down, flat condition, the blank is adapted to be expediently shipped to a food processor, who can erect the blank 120 into carton 100** and fill the carton on site without special machinery.

Figure 18:
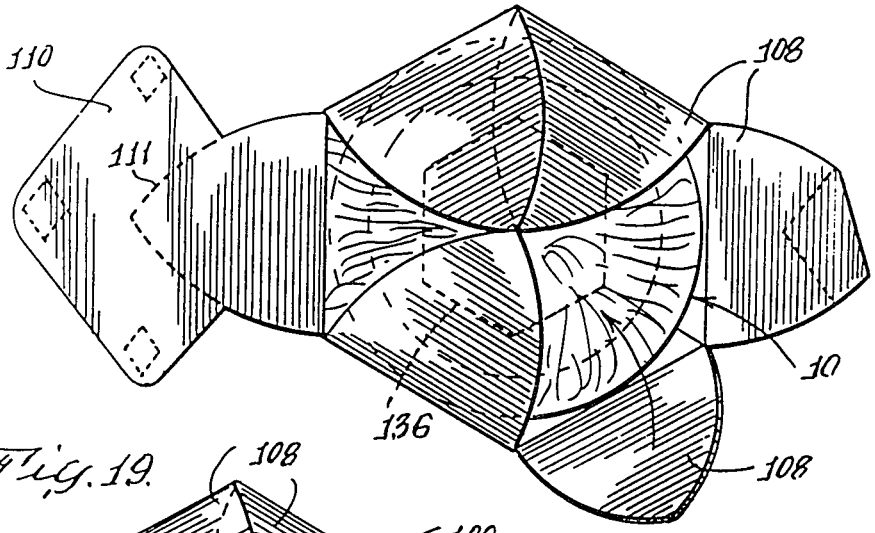

As shown in FIGS. 16 to 18, in order to assemble and fill carton 100, the folded blank of FIG. 13 is opened by pivoting trapezoidal base portion **102*a* and 102*b* 180° relative to each other about scoreline 122 so that the base portions together form a planar hexagonal surface. The sidewalls 105*a*–105*f*, inclusive will extend upwardly at an angle relative to hexagonal planar projected mouth portion 104. The triangular abutment tabs 134 aid to rigidify this construction by abutment with the trapezoidal sidewalls. If desired, a separate hexagonally - shaped panel 136 (FIG. 9) can be dropped into carton 100 onto base portion 102*a*, 102*b* (see FIG. 17) to preclude the base portions from collapsing about cut scoreline 122. Panel 136 has a shape and dimension which is identical to the combined, planar base portion 102*a*, 102*b***.

Figure 20:
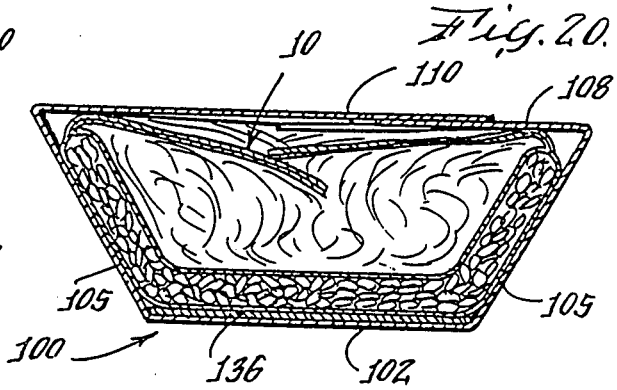
FIG. 20 is a cross-sectional view of the carton of FIG. 19 taken substantially along the plane indicated by lines 20—20 of FIG. 19.

An expandable food product pouch 10 is then inserted into the bowl-like carton 100, as shown in FIG. 18. The pouch is dimensioned so that the central food portion 12 has a diameter which provides a circumference which substantially coincides and extends along the periphery or mouth 104 of the bowl-like carton or container 100. The remainder of concentric plastic portion of the pouch 10 is then folded over the central food containing portion 12, to provide bulk for the package and the petal-like closure tabs 108 folded successively in interleaving relation about their adjacent scorelines 109 to close the mouth 104 of carton 100, as shown in FIGS. 19 and 20. Seal tab 110 is then glued or otherwise adhered to one or more of the adjacent closure tabs 108 to seal the carton 100.

Figure 21:
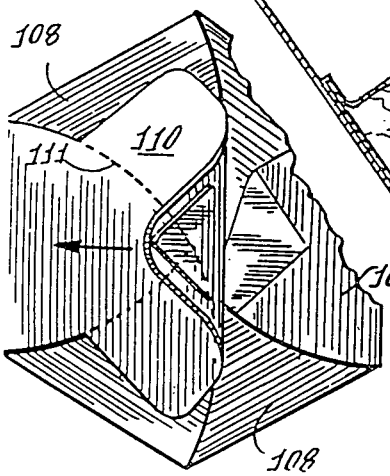
FIG. 21 is a view similar to FIG. 19, but illustrating the manner of opening the outer carton in preparation of the cooking of the expandable food in a microwave oven.

To use carton 100, seal tab 110 is opened and removed from carton 100 by tearing it along cut scoreline 111, as shown in FIG. 21. The interleaved petal-like closure 108 will tend to spring open. The carton 100 can then be placed in a microwave oven and heated along with pouch 20 and its food product 12.

Figure 22:
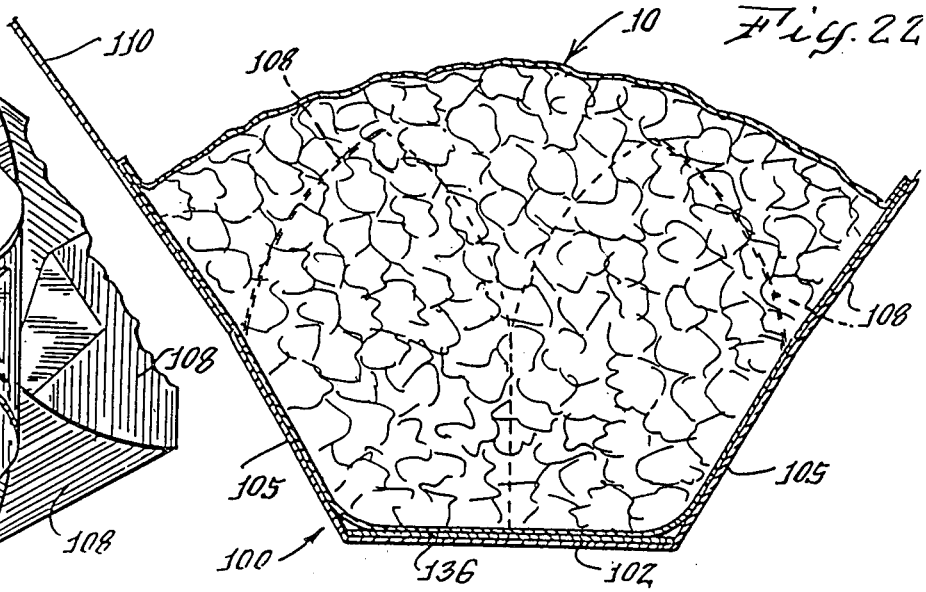
FIG. 22 is a cross-sectional view similar to FIG. 20, but illustrating the food pouch and food contained therein in an expanded state housed within the outer carton after cooking.

Upon heating in a microwave oven, pouch 10 and food product 12 will expand in a controlled, substantially vertical supported manner wholly within the interior of the outer dimensions of the bowl-like container, as shown in FIG. 22. Because the circular food product 12 has a diameter which enables the circumference of the pouch 10 to approximate and extend along the periphery of the mouth 104 of container 100, the cooking oils and fats mixed with the food product will run down the sidewalls 105 in pouch 10 and drain to the bottom of the pouch 10 as the pouch expands in the container 100 enabling the food product to continue cooking to completion.

Figure 29:
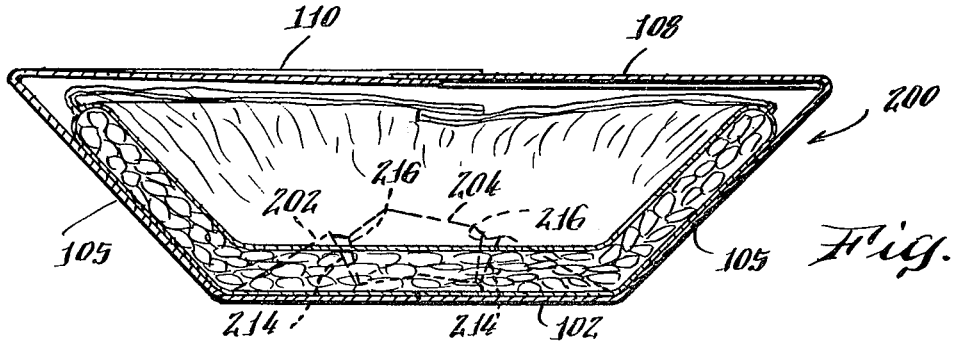
FIG. 29 is a longitudinal cross-sectional view of the outer carton formed from the blank of FIG. 23 with a food pouch inserted therein.
Figure 30:
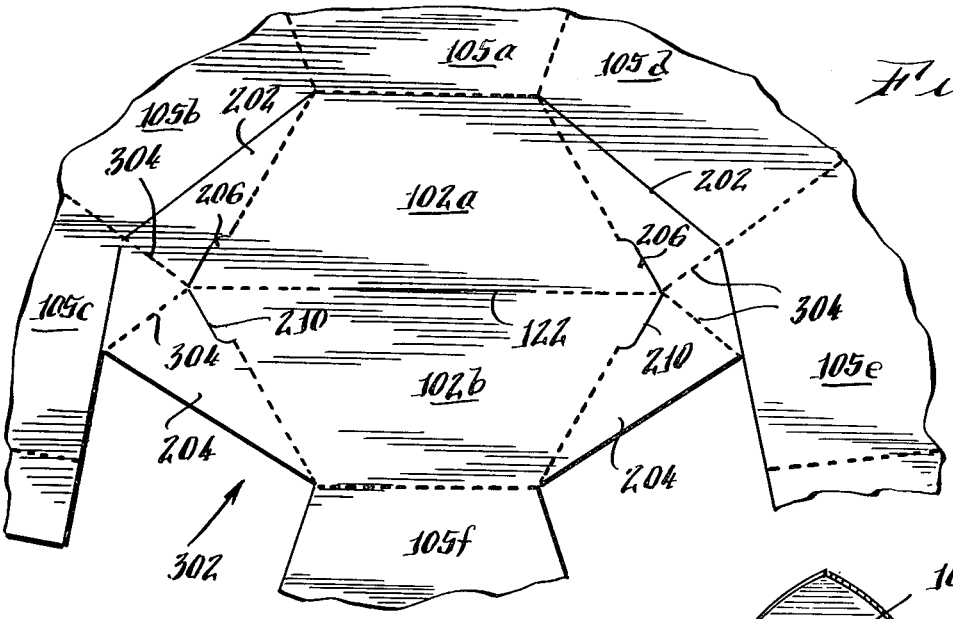
FIG. 30 is a partial plan view of still another alternate form of blank for forming the outer carton.

The carton or container 200 illustrated in FIG. 29 can be used in lieu of container 100 without the provision of an additional, separate, structural base panel 136, to prevent pivoting of the base about its central scoreline 122, once the carton is erected. The identical elements appearing in containers 100 ans 200 are indicated by like numerals.

Figure 26:
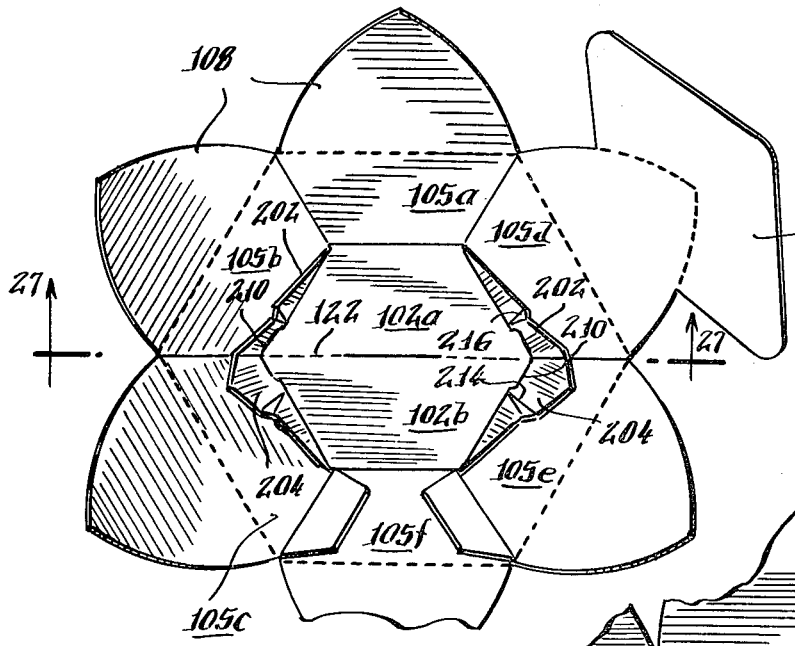
Figure 27:
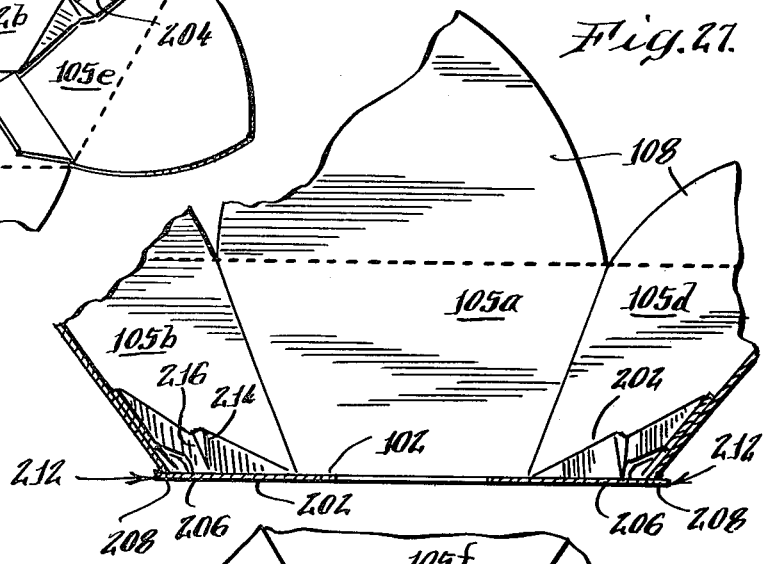

In container 200, the base 102 is provided with opposed pairs of substantially triangular abutment tabs 202, 204 which are placed in abutment with the bottom interior surface of adjacent trapezoidal sidewalls 105, as shown in FIGS. 24, 26 and 27, to rigidify the bowl-like configuration of the container or carton 200. A substantially V-shaped lock tab 206 is cut from opposite pairs of adjacent abutment tabs 202, 204 extending outwardly from the base 102. Each V-shaped lock tab 206 has an apex 208 coincident with the foldline 122 bisecting the base.

Figure 28:
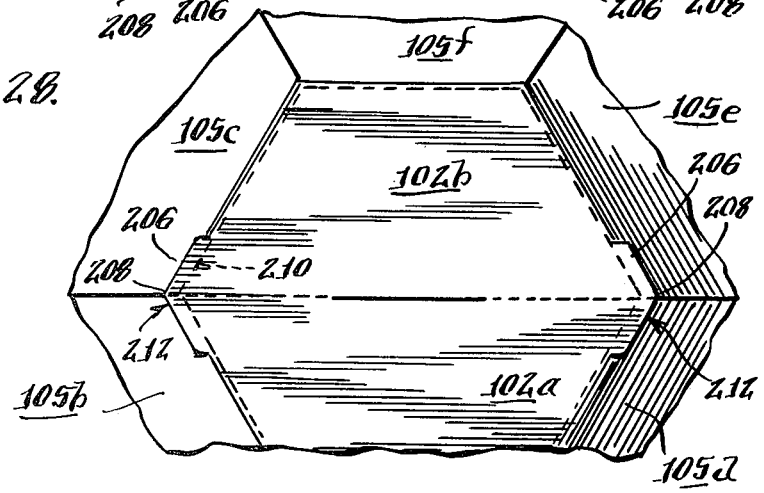

Upon erection of the carton or container 200 by placing the abutment tabs 202, 204 into contact with the bottom interior surfaces of adjacent trapezoidal sidewalls 105, the base 102 will remain substantially horizontal with the apex 208 of each V-shaped tab 206 extending through and behind its cutline 210, slightly beyond and beneath a pair of adjacent trapezoidal sidewalls as shown at 212, in FIGS. 27 and 28, to lock the base 102 in its unfolded, horizontal position.

Each individual one of the opposed pairs of triangular abutment tabs 202, 204 may be scored across its width at 214, 216, to facilitate bending of the abutment tab relative to the V-shaped lock tab 206 and release of lock tab 206 from its cutline 210. The carton material between the scorelines 214, 216, disposed at an angle with respect to each other, tends to overlap its abutment tab when its abutment tab is placed in contact with an adjacent sidewall 105 to facilitate the breaking away of tab 206 from its cutline 210 and the thrusting of each V-shaped tab 206 through the space provided by its cutline 210 upon folding of the blank formed into container 200.

Figure 31:
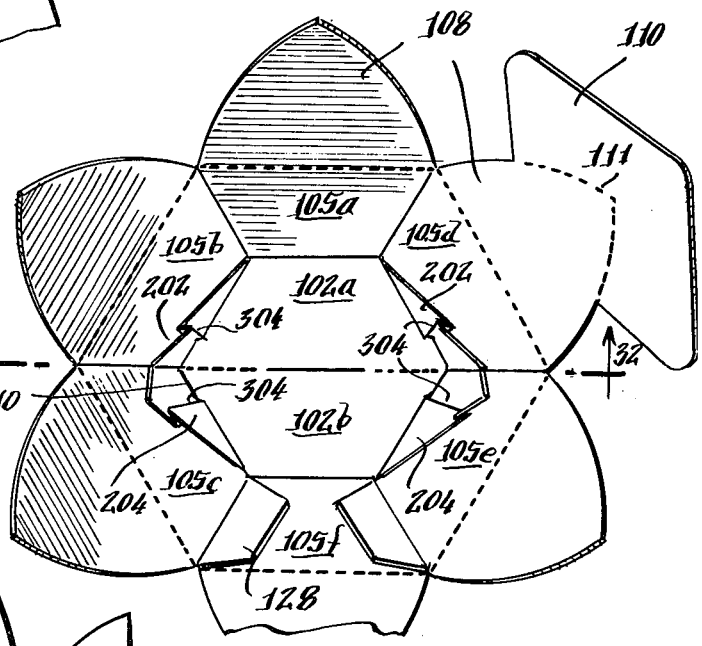
FIGS. 31 and 32 illustrate how the blank of FIG. 30 is folded to form an outer carton, with FIG. 32 comprising a cross-sectional view taken substantially along the plane indicated by line 32—32 of FIG. 31.
Figure 32:
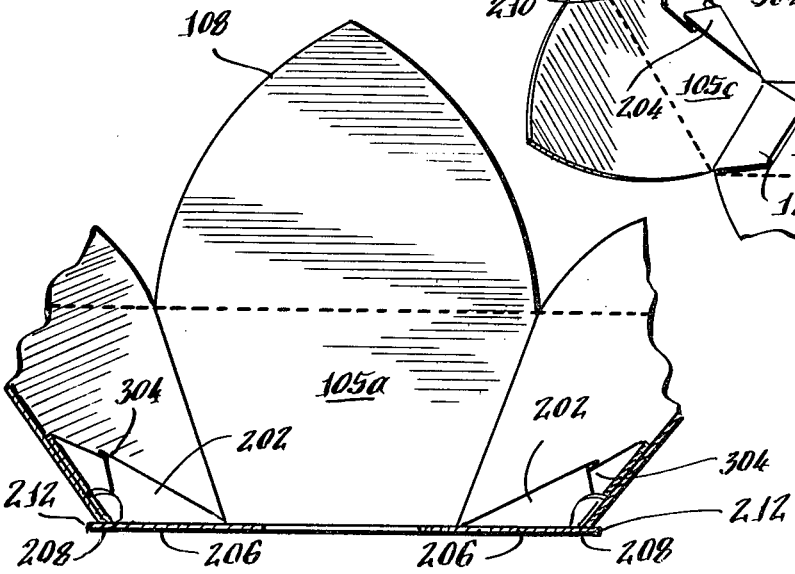
Figure 33:
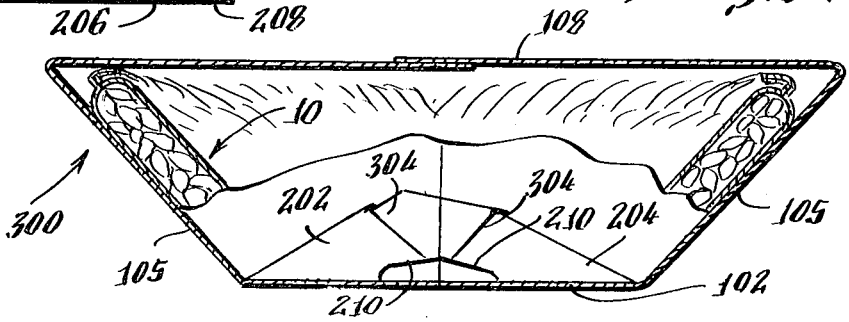
FIG. 33 is a longitudinal cross-sectional view of the outer carton formed from the blank of FIG. 30 with a food pouch inserted therein and with portions broken away to further illustrate the carton construction.
Figure 34:
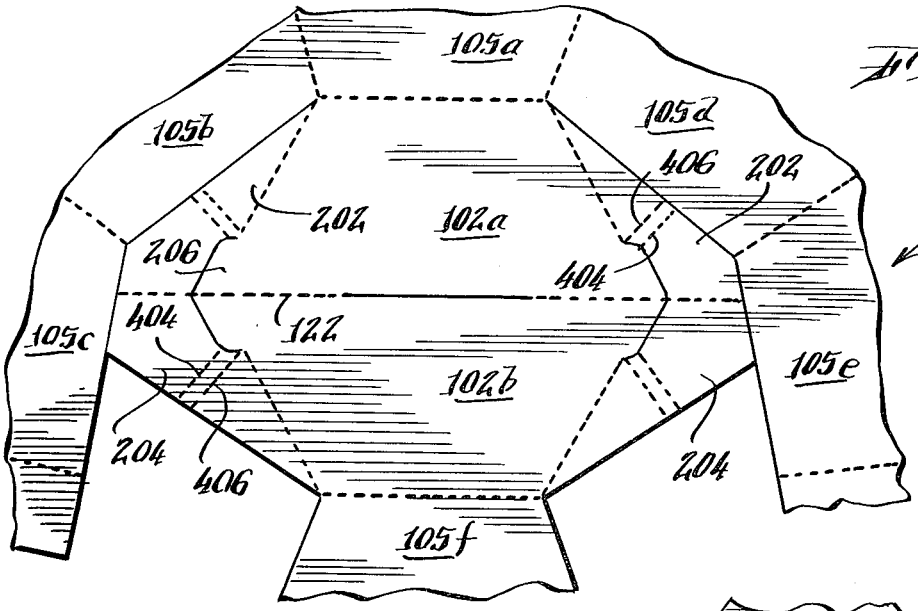
FIG. 34 is a partial plan view of another alternate form of blank for forming the outer carton.

The carton 300, as illustrated in FIG. 33, formed from the blank 302 as indicated in FIGS. 31 and 32 is identical in all respects to the carton 200, except that in lieu of the angular pairs of scorelines 214, 216 traversing each of the abutment tabs 202, 204, the V-shaped lock tab 206 release can be facilitated by a single scoreline 304 traversing each abutment tab 202, 204 enabling one abutment tab in each pair 202, 204 to fold back towards the other to release the tab 206 and enable it to be thrust below and beyond an adjacent sidewall.

Figure 35:
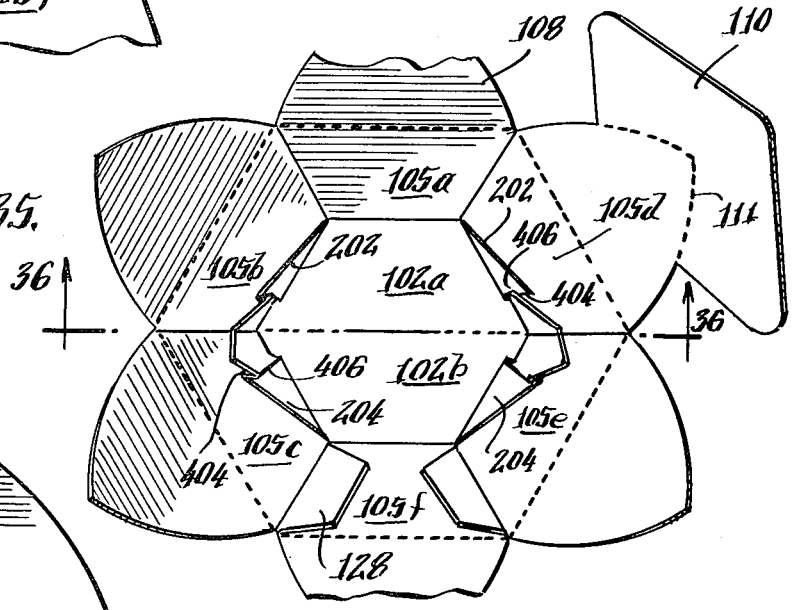
FIGS. 35 and 36 illustrate how the blank of FIG. 34 is folded to form an outer carton, with FIG. 36 comprising a cross-sectional view taken substantially along the plane indicated by line 36—36 of FIG. 35.
Figure 36:
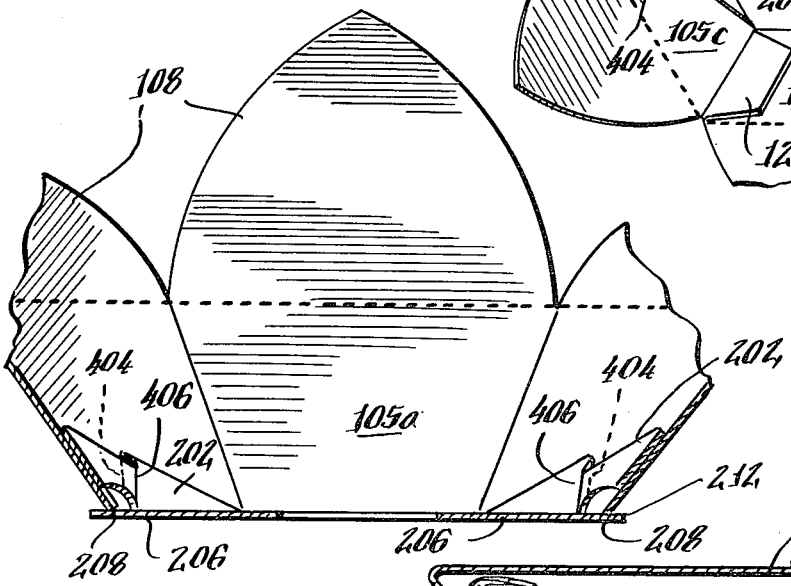
Figure 37:
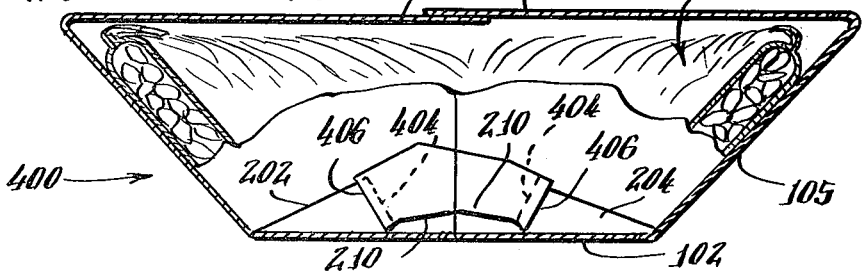
FIG. 37 is a cross-sectional view of the outer carton formed from the blank of FIG. 34 with a food pouch inserted therein and with portions broken away to further illustrate the carton construction.

The carton 400 illustrated in FIG. 37, formed from the blank 402 as indicated in FIGS. 35 and 36 is also identical in all respects to the carton 200 except that in lieu of angular pairs of scorelines 214, 216 traversing each of the abutment tabs 202, 204, the V-shaped lock tab 206 release can also be facilitated by a pair of parallel scorelines 404, 406 traversing each abutment tab 202, 204 which when the abutment tabs are placed in contact with adjacent sidewalls 105, overlap to permit the lock tab 206 to be released from its cutline and thrust through its cutline 210.

Figure 38:
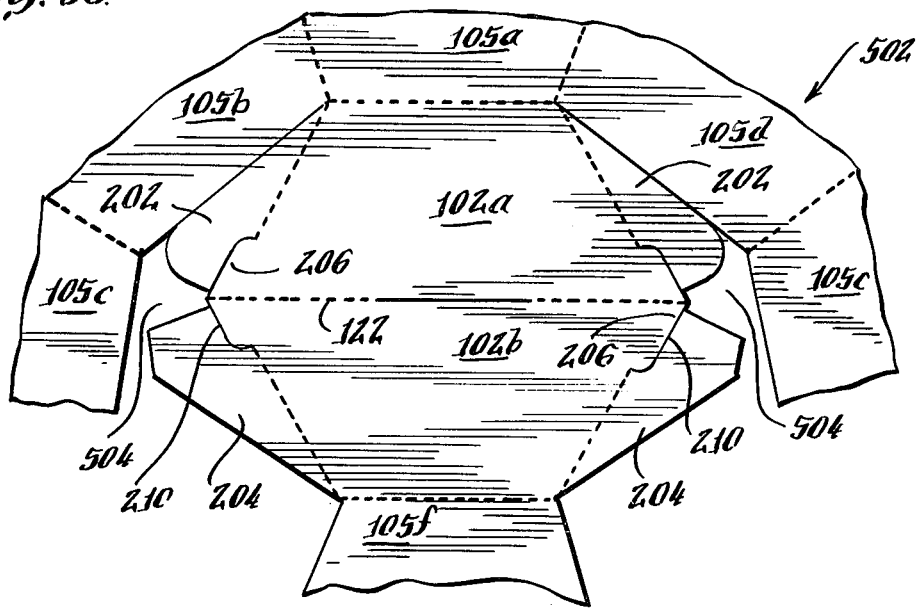
FIG. 38 is a partial plan view of another alternate form of blank for forming the outer carton.
Figure 39:
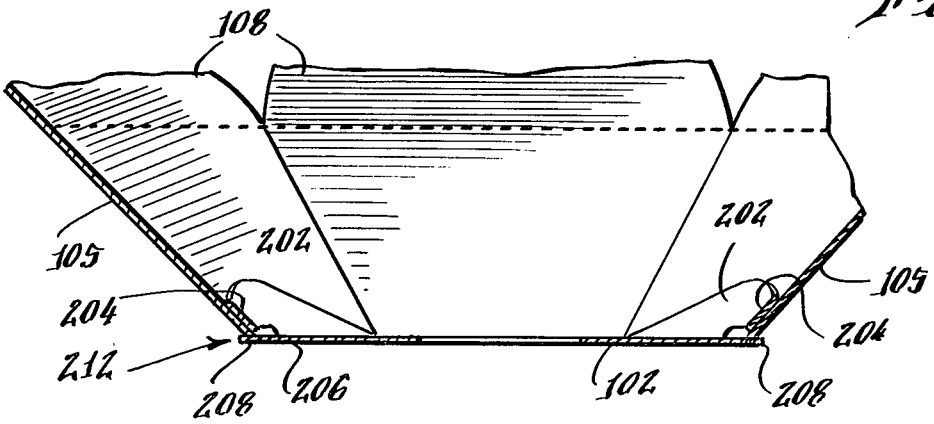
FIG. 39 is a partial longitudinal cross-section of the folded blank of FIG. 38.
Figure 40:
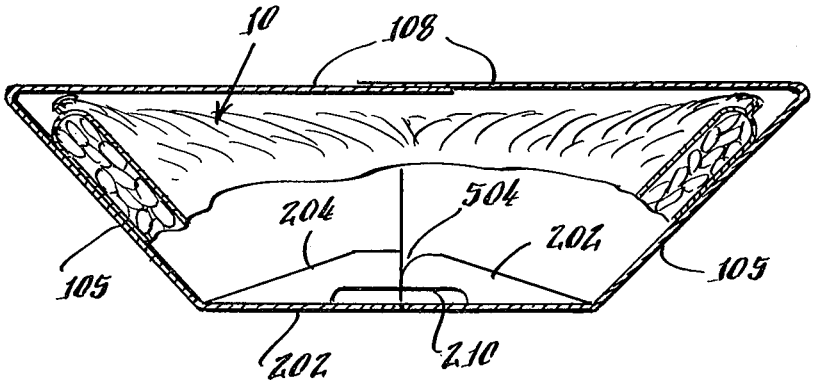
FIG. 40 is a longitudinal cross-section of the outer carton formed from the blank of FIG. 38 with a food pouch inserted therein and with portions broken away to further illustrate the carton construction.

Alternatively, the blank 502 used to form a container 500 (FIGS. 38, 39 and 40) can have its abutment tabs 202, 204 separated by a cut-out portion, as shown at 504, rather than scored transversely, to enable the V-shaped lock tab 206 to separate and extend beneath its cutline 210 upon folding of the abutment tabs. In all respects container 500 is identical to container 200.

The above description is intended to describe the present invention sufficiently to enable those of ordinary skill in the art to practice it. It is not intended, however, to detail each and every obvious modification and variation of the invention as these should be apparent to the person of ordinary skill in the art upon reading the description. It is intended, however, that all such modifications and variations of the invention to be included within the scope of which is defined by the following claims.

What is claimed is:

1. A quick-opening, non-metallic container for housing an expandable food pouch in a non-expanded and in an expanded condition comprising:

a base portion having a bottom support panel of regular polygonal shape bisected by a scoreline and adapted to be folded about said scoreline, upwardly and outwardly extending side wall panels connected to preselected ones of the edges of said polygonally shaped bottom support panel, each one of said side wall panels being connected to the adjacent one thereof to form with said bottom support panel a bowl when said bottom support panel is unfolded about said scoreline, said bowl being adapted to receive an expandable food pouch in a stored condition, a plurality of overlapped, separate top panels, each top panel having an edge resiliently and foldably connected to one of said side panels, and means connected to said bottom support panel extending between said bottom support panel and said side wall panels for locking said bottom support panel in a substantially horizontal plane relative to said sidewalls, said locking means including a pair of abutment tabs foldably connected to opposed sides of said bottom support panel adapted to be placed in contact with the interior of a pair of adjacent sidewall panels, and a V-shaped locking tab cut from at least one of said pair of abutment tabs extending at least partially beneath one of said sidewall panels.

2. The container of claim 1 wherein the bottom support panel and mouth of said outer container is hexagonal in shape.

3. The container of claim 1 wherein said side wall panels are trapezoidal in shape.

4. The container of claim 1 wherein:

said separate, overlapped top panels are interleaved, and one of said top panels includes a seal tab adapted to be adhesively connected to an adjacent top panel.

5. The container of claim 4 wherein said top panels are substantially triangular in shape.

6. The container of claim 5 wherein said seal tab is connected to said one top panel by a cut scoreline so that it can be removed therefrom upon opening of said container.

7. The container of claim 1 including an abutment tab foldably connected to selected ones of the side edges of said hexagonal bottom support panel adapted to be placed in contact with an adjacent side wall panel within the interior of said container.

8. The container of claim 1 formed from paperboard material.

9. The container of claim 1 wherein the apex of said V-shaped locking tab is coincident with the scoreline bisecting said bottom support panel.

10. The container of claim 9 wherein a portion of said V-shaped locking tab is cut from each of said abutment tabs.

11. The container of claim 10 including at least one scoreline traversing each of said abutment tabs.

12. The container of claim 11 including two parallel scorelines traversing each of said abutment tabs.

13. The container of claim 11 including two non-parallel scorelines traversing each of said abutment tabs.

14. The container of claim 9 wherein each abutment tab in each pair of abutment tabs are separated by a cut portion.

15. A blank for forming a quick-opening container for housing an expandable food pouch comprising;

a pair of substantially trapezoidal-shaped base panels comprising the mirror-image of each other foldably connected along a scoreline, a trapezoidal-shaped side panel connected to the remaining parallel edge of each of said bottom support panels, a pair of trapezoidal side panels foldably connected to each other and to opposed edges of one of said trapezoidal panels foldably connected to said base panels, a substantially triangular panel having arcuate side edges foldably connected to the larger base edge of each of said trapezoidal side panels, and a substantially triangular abutment panel foldably connected to each of the side edges of each of said base panels, a pair of adjacent ones of said abutment panels including a V-shaped locking tab cut therein, said locking tab having an apex coincident with said scoreline foldably connecting said trapezoidal-shaped base panels.

16. The blank of claim 15 wherein said trapezoidal side panel connected to one of said base panels is spaced from said pairs of trapezoidal side panels connected to the other of said trapezoidal side panels.

17. The blank of claim 16 including a seal tab connected by a cut scoreline to the outer periphery of one of said triangular panels connected to each of said trapezoidal side panels.

18. The blank of claim 15 wherein said adjacent pair of abutment panels are separated by a cut portion from each other.

19. The blank of claim 15 wherein said adjacent pair of abutment panels are connected to each other and each of said abutment panels includes at least one transverse scoreline.

20. The blank of claim 19 wherein each abutment panel includes a pair of transverse scorelines.

21. The blank of claim 20 wherein each of said pair of transverse scorelines are parallel to the other.

22. The blank of claim 20 wherein each of said pair of transverse scorelines are at an acute angle to the other.

* * * * *